US005697266A

United States Patent [19]

Wilson, Jr.

[11] Patent Number: 5,697,266

[45] Date of Patent: Dec. 16, 1997

[54] LINE FITTING ORIENTATION GUIDE FOR A FITTING MANIPULATING TOOL INCLUDING A SPLIT SOCKET AND COMBINATION THEREOF

[76] Inventor: David Wilson, Jr., 8022 Dry Creek Cir., Longmont, Colo. 80503

[21] Appl. No.: 528,809

[22] Filed: Sep. 15, 1995

Related U.S. Application Data

[63] Continuation-in-part of Ser. No. 307,349, Sep. 16, 1994, Pat. No. 5,537,897, and a continuation-in-part of Ser. No. 299,211, Aug. 31, 1994, Pat. No. 5,522,285, which is a continuation-in-part of Ser. No. 276,506, Jul. 18, 1994, Pat. No. 5,460,062, which is a continuation of Ser. No. 25,949, Mar. 3, 1993, abandoned.

[51] Int. Cl.[6] ..... B25B 21/00

[52] U.S. Cl. ..... 81/57.14; 81/57.3

[58] Field of Search ..... 8/57.13, 57.14, 8/57.29, 59.3, 58.2, 57.24, 180.1, 184, 185.2

[56] References Cited

U.S. PATENT DOCUMENTS

| | | | |
|---|---|---|---|
| 1,477,184 | 12/1923 | Ormsby . | |
| 1,648,134 | 11/1927 | Kientz . | |
| 2,505,186 | 4/1950 | Hubbard . | |
| 2,537,175 | 1/1951 | Viets . | |
| 2,550,045 | 4/1951 | De Hetre | 81/57.24 X |
| 2,551,669 | 5/1951 | Hale . | |
| 2,578,686 | 12/1951 | Fish . | |
| 2,630,731 | 3/1953 | Imboden . | |
| 2,649,823 | 8/1953 | Markovich . | |
| 2,700,315 | 1/1955 | Hermanson . | |
| 2,712,259 | 7/1955 | Cowell . | |
| 2,719,446 | 10/1955 | Ford . | |
| 3,079,820 | 3/1963 | Ventchoura . | |
| 3,257,877 | 6/1966 | Ulrich et al. . | |
| 3,477,318 | 11/1969 | Batten . | |
| 3,535,960 | 10/1970 | Borries . | |
| 3,602,071 | 8/1971 | Juhasz . | |
| 3,620,105 | 11/1971 | Batten . | |
| 3,812,745 | 5/1974 | Wehmeyer . | |
| 3,927,582 | 12/1975 | Hertelendy et al. . | |
| 4,374,479 | 2/1983 | Minotti . | |
| 4,402,239 | 9/1983 | Mooney . | |
| 4,928,558 | 5/1990 | Makhlouf | 81/57.13 X |
| 4,928,559 | 5/1990 | Stielow . | |
| 4,972,741 | 11/1990 | Sabille . | |
| 5,050,463 | 9/1991 | Stielow . | |
| 5,161,438 | 11/1992 | Pietras . | |
| 5,161,439 | 11/1992 | Wesch, Jr. . | |
| 5,230,263 | 7/1993 | Kwaka | 81/180.1 X |
| 5,259,275 | 11/1993 | Schulze-Beckinghausen . | |
| 5,271,298 | 12/1993 | Gazel-Anthoine . | |
| 5,282,830 | 2/1994 | Reynolds | 81/58.2 X |

FOREIGN PATENT DOCUMENTS

| | | | |
|---|---|---|---|
| 161947 | 3/1955 | Australia | 81/58.2 |

*Primary Examiner*—James G. Smith
*Attorney, Agent, or Firm*—Harold A. Burdick

[57] ABSTRACT

Line fitting orientation guides for use with a split socket and socket drive assembly are disclosed, the guides including an opening for receiving and abutting the line on which the fitting is maintained as the fitting is received and properly positioned in the socket. The orientation guide may be integral to either the socket or the drive assembly structure, or may be a separate unit mounted to the drive assembly structure.

9 Claims, 13 Drawing Sheets

LINE FITTING ORIENTATION GUIDE FOR A FITTING MANIPULATING TOOL INCLUDING A SPLIT SOCKET AND COMBINATION THEREOF

RELATED APPLICATION

This application is a continuation-in-part of now pending U.S. patent application Ser. No. 08/307,349 filed Sep. 16, 1994 by David Wilson Jr. and entitled "Split Socket With Movable Facets and Drive Assembly" U.S. Pat. No. 5,537, 897. U.S. patent application Ser. No. 08/307,349 is a continuation-in-part of now pending U.S. patent application Ser. No. 08/299,211 filed Aug. 31, 1994 and entitled "Mechanism For Locating A Slotted Socket Relative To A Drive Transfer Housing And Combination Thereof" by David Wilson Jr. and Bruce D. Stefen U.S. Pat. No. 5,522, 285, (which is a continuation-in-part of now pending U.S. patent application Ser. No. 08/276,506 filed Jul. 18, 1994 and entitled "Reaction Unit for Threaded Connector Manipulating Device and Combination Thereof" by David Wilson, Jr. U.S. Pat. No. 5,460,062, which in turn is a file wrapper continuation of now abandoned U.S. patent application Ser. No. 08/025,949 filed Mar. 3, 1993 and entitled "Compact Manipulating Device For Threaded Connectors" by David Wilson, Jr.), and is a continuation-in-part of now pending U.S. patent application Ser. No. 08/276,506 as further identified hereinabove.

FIELD OF THE INVENTION

This invention relates to fitting manipulating tools such as wrenches, sockets and socket drivers, and, more particularly, relates to slotted wrenches, sockets and drivers.

BACKGROUND OF THE INVENTION

Wrenches and sockets having a gap at one part thereof to allow passage of a line into the tool are well known (in the case of sockets, being generically referred to as split, or slotted, sockets). In the actual use of many now known slotted sockets on a line fitting, a sequence of specific steps is required to use the tool. First, the slot in the socket and the slot in a socket driver housing must be brought into correspondence to allow proper positioning of the fitting in the socket.

The continuous line is then introduced to the center of the socket and the tool is moved axially until the multi-faceted annulus of the socket is engaged on the nut. The operator of the tool may then actuate rotation of the socket to rotate the fitting as desired, after which the tool is moved axially off the fitting. Typically the slot of the socket and the slot of the housing are not in agreement after the operation thus often requiring the operator to again bring the slots into correspondence for removal of the tool from the line.

The principal disadvantage to the current method of use of such tools is the need for clearance above or below the fitting for maneuvering the tool into operative position (with the socket engaged on the fitting) and for moving the socket off the fitting to realign the gaps so that the tool can be removed from the line without continuing to turn the fitting (necessary to prevent over or under torquing, accidental reengagement or the like). Such clearances are not always available, or, if made available (of necessity for maintenance in a particular application), may have inhibited optimal design of the structure.

Moreover, the diameter of a hydraulic line needs to be smaller than the flat to flat dimension of the socket (i.e., the distance between directly opposite fitting engaging facets) in order for many heretofore known tools to be used. This has been due to the necessity for movement of the socket along the line to achieve engagement and/or disengagement from the fitting. It is thus apparent that further improvement of such tools could be utilized to achieve greater flexibility and ease of use.

One solution to some of the foregoing problems involves ratcheting type tools which are configured to turn the fitting when moved in one direction but not when rotated in the other (see, for example, U.S. Pat. Nos. 2,712,259, 2,537,175, 2,578,686, 2,649,823, 2,551,669 and 3,927,582). These tools, however, have often involved numerous parts, cumbersome, complex and/or easily damaged structure, and have not always been easily adapted for use in confined spaces and/or with power driving mechanisms. Various other tools have been suggested which use gear driven sockets or the like (see U.S. Pat. Nos. 5,050,463, 3,620,105, 4,374,479, 2,630,731 and 1,648,134). These tools, however, also do not always provide for minimal manual manipulation of the tool during use, and/or do not always optimize flexibility and ease of utility (in the application, withdrawal and/or proper alignment of the tool during use), mechanical durability and thus reliability, and compactness of structure.

SUMMARY OF THE INVENTION

This invention provides a line fitting orientation guide claimed either alone or in combination with a tool. The guide aids in the provision of minimal manual manipulation of the tool during use, and safety, flexibility and ease of utility of the tool (in the application, withdrawal and/or proper alignment of the tool relative to the fitting during use).

The orientation guide is adapted for use with a fitting manipulating tool that includes a split socket for rotating a threaded line fitting while the fitting is in place around a line and a drive transfer assembly having the socket rotatably mounted therein. The socket has an inner periphery configured to hold the fitting during manipulation thereof and an outer periphery, a fitting receiving gap in the socket being provided from the outer periphery to the inner periphery, the gap of a size to permit passage of the fitting therethrough. The guide is particularly useful with a split socket having movable facets for gripping the fitting.

The guide comprises structure at either the socket or the drive transfer assembly having a line receiving opening aligned with the gap in the socket but of a size different from the gap in the socket and configured to snugly receive the line therethrough when the fitting is being passed through the gap in the socket. An abutment at one end of the opening contacts the line when the fitting is properly positioned at the inner periphery of the socket. The orientation guide may be formed by (i.e., integral to) either the housing of the drive transfer assembly or a planar surface section of the socket, or may be a separate structure including means for attachment to a wall of the housing adjacent to a fitting receiving gap thereat, with the opening in alignment with the gap, and with one surface of the structure adjacent to the inner periphery of the split socket.

The orientation guide may be sized for use with a particular line size, or may be provided with relatively movable members having the line receiving opening defined therebetween, the opening size being variable with relative movement between the movable members. In either case, the line fitting orientation guide is configured to allow "straight on" application of the socket to a fitting (and "straight off" removal) independent of orientation of the facets of the fitting relative to the socket.

It is therefore an object of this invention to provide an improved line fitting orientation guide for use with a tool including a split socket for manipulating the fitting and combination thereof.

It is another object of this invention to provide an improved line fitting orientation guide for use with a split socket drive tool that aids in the provision of minimal manual manipulation of the tool during use, and safety, flexibility and ease of utility of the tool (in the application, withdrawal and/or proper alignment of the tool relative to the fitting during use).

It is another object of this invention to provide an orientation guide for use with a split socket having a movable facet or facets.

It is still another object of this invention to provide a line fitting orientation guide for use with a split socket and drive assembly configured to allow "straight on" application of the socket to a fitting (and "straight off" removal) independent of orientation of the facets of the fitting relative to the socket.

It is yet another object of this invention to provide a line fitting orientation guide for use with a fitting manipulating mechanism, the mechanism including a split socket for rotating a threaded line fitting while the fitting is in place around a line and a drive transfer assembly having the socket rotatably mounted therein and engageable with drive means for rotating the socket, the socket having an inner periphery configured to hold the fitting during manipulation thereof and an outer periphery, a fitting receiving gap in the socket being provided from the outer periphery to the inner periphery, the gap of a size to permit passage of the fitting therethrough, the guide comprising structure at one of the socket and the drive transfer assembly having a line receiving opening aligned with the gap in the socket but of a size different from the gap in the socket and configured to snugly receive the line therethrough when the fitting is being passed through the gap in the socket, the structure including an abutment at one end of the opening for contacting the line when the fitting is properly positioned at the inner periphery or the socket.

It is still another object of this invention to provide a line fitting orientation guide for use with a fitting manipulating tool that is either integral to the tool's structure or attachable to the tool.

It is still another object of this invention to provide a line fitting orientation guide used with a fitting manipulating tool that includes first and second relatively movable members having a line receiving opening defined therebetween, the opening size being variable with relative movement between the movable members.

It is yet another object of this invention to provide a line fitting orientation guide for use with a device for manipulating a threaded line fitting while the fitting is in place around the line, the device for releasable engagement with a power driver and including a split socket having an inner periphery and an engageable outer periphery together defining a part of a side wall, the side wall having a gap large enough to allow passage of the fitting therethrough to the inner periphery of the socket, the inner periphery having first and second opposing surfaces and an arcuate surface extending between the first and second surfaces from one end of each surface, the device further including a drive transfer assembly with a housing having the split socket rotatably mounted therein, the housing having a gap at one part thereof substantially corresponding in one dimension to the gap in the side wall of the socket, the gaps being in register when the socket is rotated to a selected position, the guide including structure defining a surface and a line receiving opening through the surface of a size different from the gaps in the socket and housing and configured to snugly receive the line therethrough, the structure including an abutment at one end of the opening for contacting the line and means for attachment of the structure to the housing of the drive transfer assembly adjacent to the gap thereat, with the opening in alignment with the gap thereat, and with the surface adjacent to the inner periphery of the split socket.

It is yet another object of this invention to provide a device for manipulating a threaded line fitting while the fitting is in place around the line, the device for releasable engagement with a power driver, the device including a split socket having an inner periphery and an engageable outer periphery together defining a part of a side wall, the side wall having a gap therein to allow positioning of the fitting at the inner periphery of the socket, the inner periphery having first and second opposing surfaces with a first member movably maintained adjacent to the first surface and a second member movably maintained adjacent to the second surface, and a drive transfer assembly including a housing having the split socket rotatably mounted therein, the housing having a gap at one part thereof substantially corresponding in one dimension to the gap in the side wall of the socket, and drive means mounted in the housing for imparting rotational motion to the socket and having a portion configured to be releasably engaged with the driver, the gaps being in register when the socket is rotated to a selected position, the housing having a structure adjacent to the gap of the housing with an opening of a size configured to receive the line therethrough but of a size different than the gaps.

With these and other objects in view, which will become apparent to one skilled in the art as the description proceeds, this invention resides in the novel construction, combination, and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figures 1, 2:
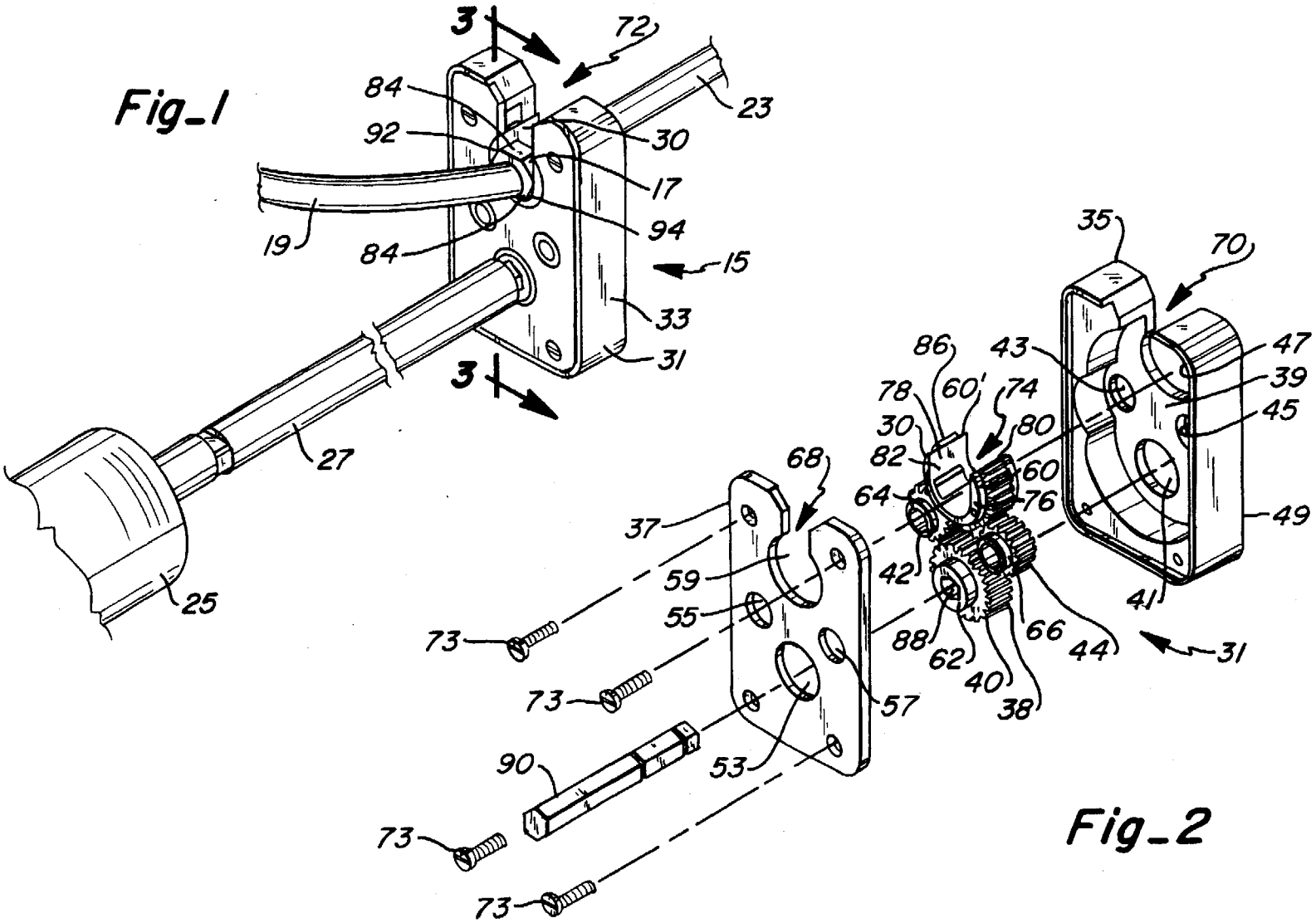
FIG. 1 is a perspective view showing both the split socket and drive assembly of this invention.
FIG. 2 is an exploded view of the units of FIG. 1.
Figure 3:
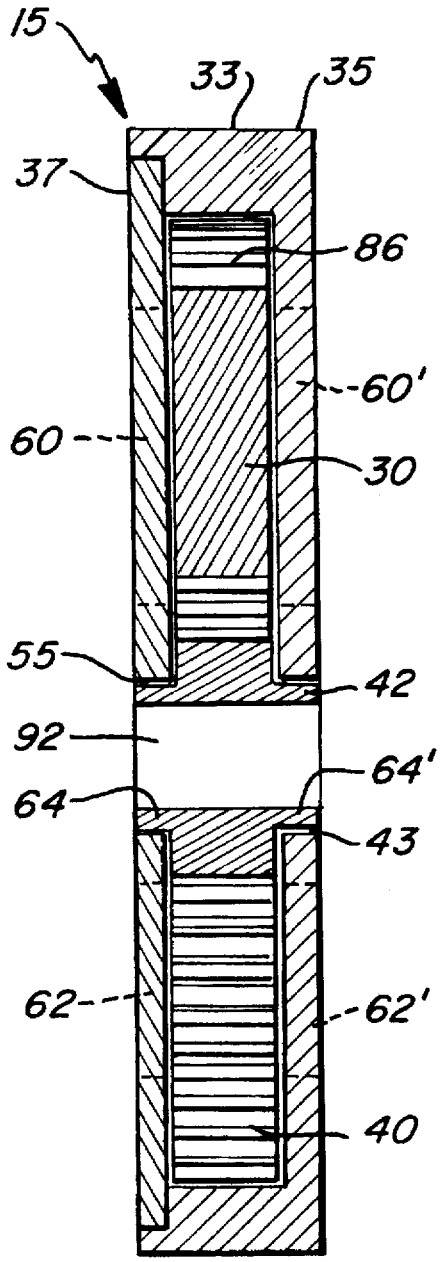
FIG. 3 is a sectional view taken through section line 3—3 of FIG. 1.

A first embodiment 15 of the split socket and drive transfer assembly of this invention is illustrated in FIGS. 1 through 3. Device 15 is shown in FIG. 1 in use to manipulate line fitting 17 around line segment 19 into engagement or disengagement with a matable fitting (not shown) around line segment 23. Device 15 is releasably engaged with power driver 25 using flexible shaft 27 (any suitable connection could be utilized).

Device 15 includes split socket 30 and drive transfer assembly 31. Drive transfer assembly 31 includes housing 33, formed by main housing body 35 and cover section 37, and gear train 38 including main drive gear 40 and linkage gears 42 and 44 for imparting rotational motion to socket 30 when driven by driver 25. Housing body 35 has indented structure 39 formed therein and openings 41, 43, 45 and 47 through rear wall 49 for housing socket 30 and gear train 38. Cover section 37 includes openings 53, 55, 57 and 59, the corresponding openings in body 35 and cover section 37 receiving arcuate shoulders 60, 60', 62, 62', 64, 64', and 66, 66' (66' not shown but being substantially the same as 64') of socket 30 and gears 40, 42 and 44, respectively, thus eliminating any need for axles, shafts, bearings and the like.

Both cover section 37 and main body 35 include gaps 68 and 70, respectively extending from openings 59 and 47, respectively, the thus formed gap 72 in housing 33 (when assembled, utilizing, for example, machine screws 73) corresponding in size to gap 74 formed in side wall 76 of socket 30 between spaced edges, or surfaces, 78 and 80 thereof. Side wall 76 is defined between inner periphery 82 for receiving the connector to be manipulated (as shown herein a hex fitting configuration with a plurality of facets 84) and the outer periphery of the socket which includes engagable outer periphery 86 as well as the outer periphery of shoulders 60 and 60'.

Drive gear 40 includes power driver attachment opening 88 for receipt of a rotatable shaft (such as flex shaft 27 or rigid shaft 90). Gear 40 and socket 30 may be sized relative to one another as desired, for example to provide gear reduction. The housing, socket and gears are preferably formed of metals, though various plastics could be utilized in some applications for some of the parts of the device. While various sizes of device 15 are employed depending upon the size of connector involved, all are compact relative to the task, compactness, as well as durability, being achieved because of the particular relationship of gap size and gear sizes and/or placement of gears.

In one particularly useful embodiment of the device, gap 74 in socket 30 and gap 72 in housing 33 are equal to or, preferably, greater than the greatest diameter of fitting 17 (i.e., the distance between opposite points 92 and 94 of the fitting for a hex nut, for example, in FIG. 1). In this manner, the fitting can be passed directly through the gaps into or out of inner periphery 82 of socket 30. Thus, no clearance above or below the fitting is required to achieve socket engagement or disengagement when gaps 74 and 72 are aligned.

Figure 4A:
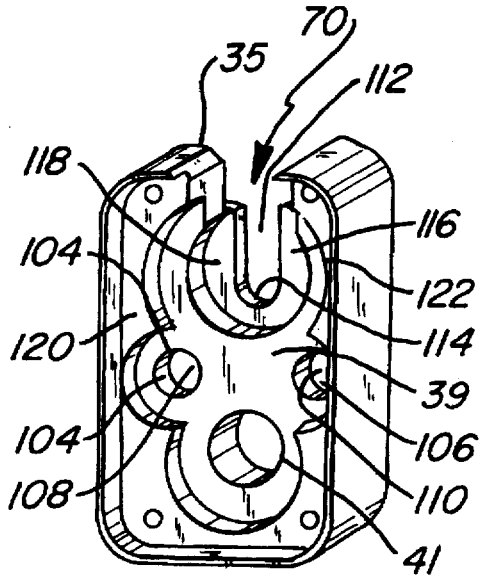
FIGS. 4A and 4B are perspective views of housing designs utilizing the line fitting orientation guide structure of this invention.
Figure 5:
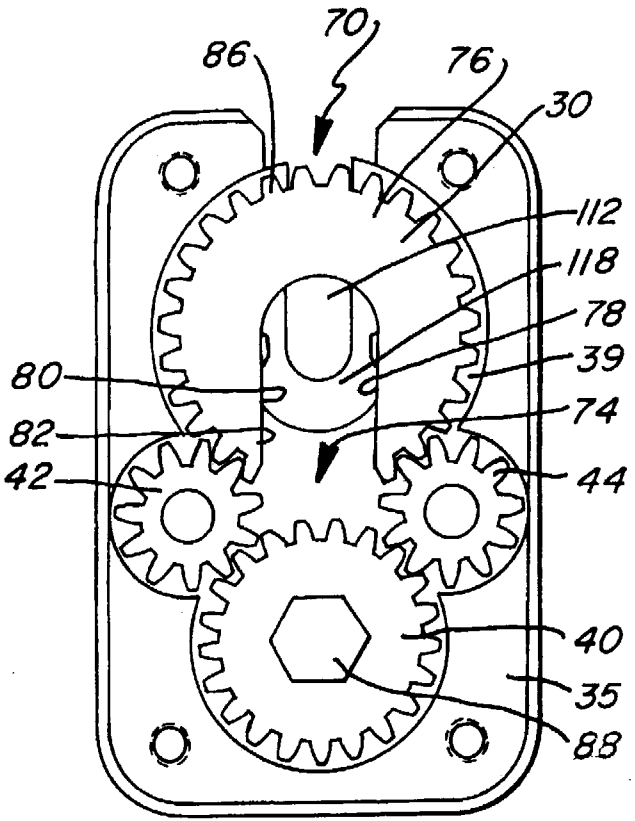
FIG. 5 is sectional illustration showing the drive assembly positioned in the housing of FIG. 4A.

FIGS. 4A and 5 show a preferred alternative design for main body 35 of housing 33 which is usable with threaded connector manipulating devices as heretofore described. Many features of main body 35 remain the same, including indented structure 39 and opening 41. However, instead of openings for gears 42 and 44, cavities 104 and 106 are provided which are closed at ends 108 and 110, respectively. In addition, line opening 112 (part of the structure forming a first embodiment of the line fitting orientation guide of this invention) has a dimension greater than line 19 but less than gap 70 to its terminus at end 114. Webbed fitting receiving pocket 116 is thus provided having back wall 118. Together, increased housing strength against flexure at shoulders 120 and 122 under applied torque (about 100% greater than the other design shown herein) and/or the ability to construct the housing of less expensive materials is provided by this alternative design. Moreover, wall 118 provides a positive stop for fasteners received in socket 30 and the bottom end of line opening 112 provides a surface against which line 19 is maintained during user operation of the device. Thus proper alignment of the fastener therein is assured both initially and during operation of the device of this invention (i.e., the opportunity for the user to push socket 30 free of proper positioning in engagement with the fastener during part of the rotation of the socket is avoided by providing the line abutting surface at the bottom end of opening 112, and the fastener is squarely oriented and properly positioned in socket 30 initially by contacting the line at the bottom of the opening and bringing the fastener flush with wall 118).

Figure 4B:
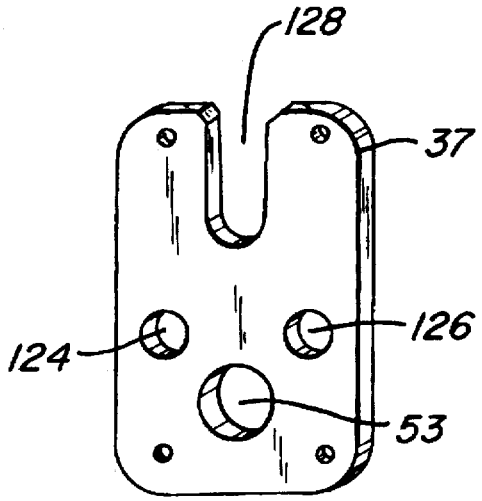

FIG. 4B illustrates an alternative design for cover section 37, again with many similarities to that heretofore described. Again, cavities 124 and 126 may be provided for linkage gears 42 and 44 rather than openings, and line opening 128 (like opening 112) provides increased strength and a positive line and fastener stop (it should be noted, of course, that while both could be so constructed for application in a single housing, only one or the other of openings 112 and 128 of housing body 33 and cover 37 is provided in this fashion for most applications).

FIG. 5 illustrates the relationship of gap 74 in socket 30 to gears 42 and 44 to assure constant running of socket 30 (i.e., one or the other of gears 42 and 44, and for most of a rotation both, will always be in driving engagement with socket 30), as well is the relationship of gap 74 to wall 118 and line opening 112. The particular socket and drive assembly housing shown in FIG. 5 is sized for a small line fitting, for example as are used for electrical and cable connectors and some other lines.

Figure 6:
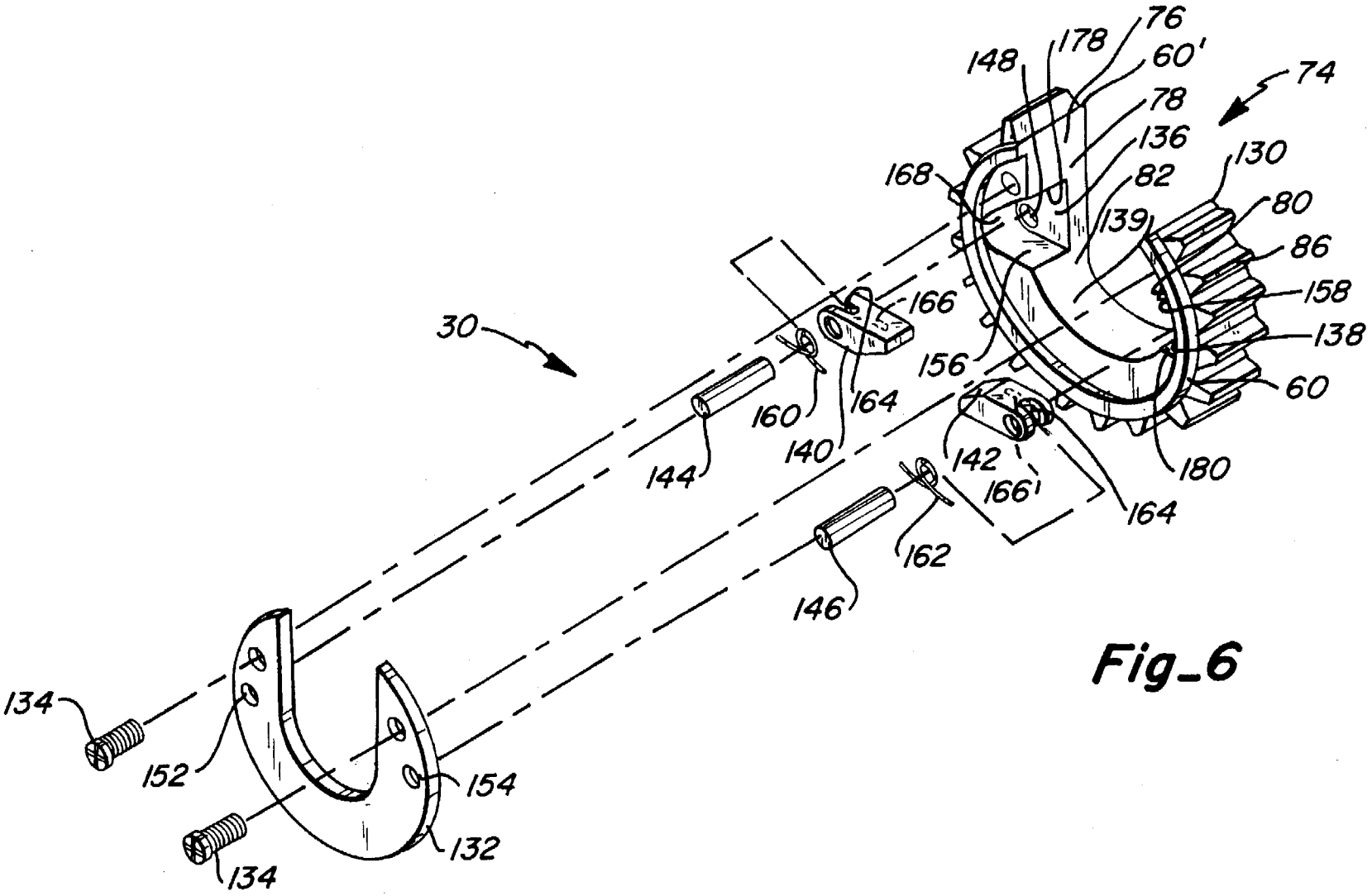
FIG. 6 is an exploded view of the split socket having movable facets of this invention.

FIG. 6 shows the preferred embodiment of split socket 30, including socket body 130 and cover portion 132 connectable by connectors 134. Socket body 130 includes indented structures 136 and 138 at surfaces 78 and 80, respectively, of side wall 76. Surfaces 78 and 80 terminate at arcuate surface 139 below indented structures 136 and 138, surface 139 serving as a positive stop (and, in part, a bearing surface) for fitting 17 at inner periphery 82 of socket 30. Dog members 140 and 142 are pivotably mounted on shafts 144 and 146, respectively, in structures 136 and 138, respectively, shafts 144 and 146 being maintained in cavities 148 in indented structures 136 and 138 in socket body 130 (only one of which is shown in FIG. 6 in structure 136, a like cavity being positioned in structure 138) and cavities 152 and 154, respectively, in cover portion 132.

Dog members 140 and 142 are biased toward stop walls 156 and 158 of structures 136 and 138, respectively, by torsion springs 160 and 162, respectively, mounted around their respective shafts and housed in gaps 164 of the respective dog member. Springs 160 and 162 each have one end maintained in holes 166 of the respective dog member and the other end maintained in holes 168 of their respective indented structure (only one of which is shown in structure 136 in FIG. 6).

Figure 7:
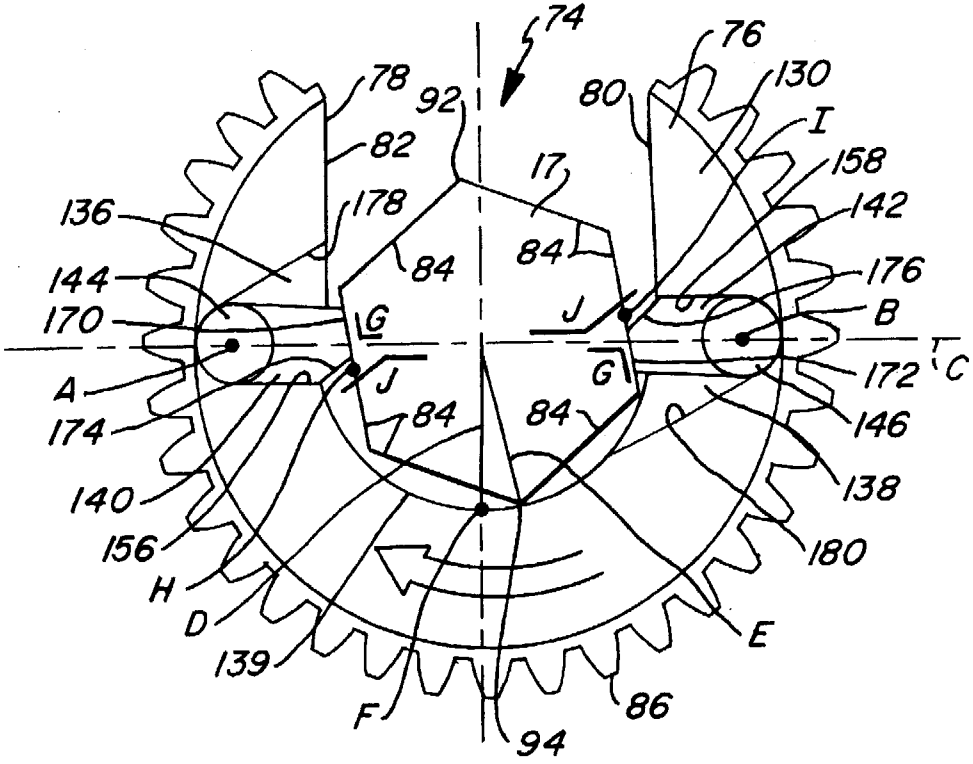
FIG. 7 is an illustrations of the spatial relationships of the movable facets and the socket body.

FIG. 7 illustrates the preferred relative placement and angles of the indented structures, dog members and pivot points in wall 76 of socket body 130 for any particular size of fitting 17 to be manipulated (other angles, placement, facet sizes and the like could, of course, be utilized). Shafts 144 and 146 are mounted so that pivot points A and B define line C which is substantially perpendicular to surfaces 78 and 80. Proper joint positioning of the pivot points along the surfaces is determined by the size of the fitting 17 to be manipulated by socket 30. Line D (terminating at arcuate surface 139) is equal in length to line E, which is one-half of the widest diameter of fitting 17 (in FIG. 7 shown as the point 92 to point 94 diameter of a hex fitting). Line D is defined by the dashed line bisecting gap 74 and arcuate surface 139 (running through arcuate surface center point F). Thus, line C (when the pivot points are properly positioned) is perpendicular to line D, the lines intersecting at approximately the center of a fitting to be inserted in socket 30.

Facets 170 and 172 of members 140 and 142 for engaging to rotate fitting 17 are preferably fully contacted by facets 84 of fitting 17 at about zero to 20° (preferably about 15°) of relative rotation 15° of movement of point F of arcuate surface 139 relative to point 94 of fitting 17). Thus, where the fitting is a hex fitting, when the facets fully contact the sides of the fitting to rotate the fitting, about zero to 20° (preferably about 15°) of relative rotation between surfaces 78 and 80 of inner periphery 82 of socket 30 and the contacted sides, or facets 84, of the hex fitting is maintained (plus or minus 15° in FIG. 7 depending on the surface 78/80 and facet 84 pair being considered).

This relationship may be brought about using the preferred angles G of facets 170 and 172 relative to line C (about 90° to 110°, preferably about 105°). Facets 170 and 172 are of a length less than one-half the length of one facet 84 of fitting 17. Members 140 and 142 are of a length from pivot points A and B to facets 170 and 172, respectively, sufficient to allow a meeting along the entire facets 170/172 surfaces with facets 84 of the fitting when fully engaged (preferably, the length of members 140 and 142 is equal to about one-half of the distance between points H and I, each defined as a midpoint of a facet 84). Stop walls 156 and 158 are positioned so that, upon full engagement of fitting 17 by facets 170/172, the facets are located at one side of midpoints H and I of fitting 17 (one above and one below the midpoints as shown in FIG. 7).

Angles J represent the angular relationship between facets 174 and 176 of members 140 and 142 and line C (preferably about 135°). Facets 174 and 176 are contacted by fitting 17 when rotation of socket 30 is opposite that illustrated in FIG. 7, being then pivoted away toward walls 178 and 180 of structures 136 and 138, respectively. Walls 178 and 180 are positioned to allow sufficient pivoting of members 140 and 142 so that facets 174 and 176 are at least about aligned with surfaces 78 and 80, respectively, when fully pivoted (see FIG. 8C).

Figure 8A:
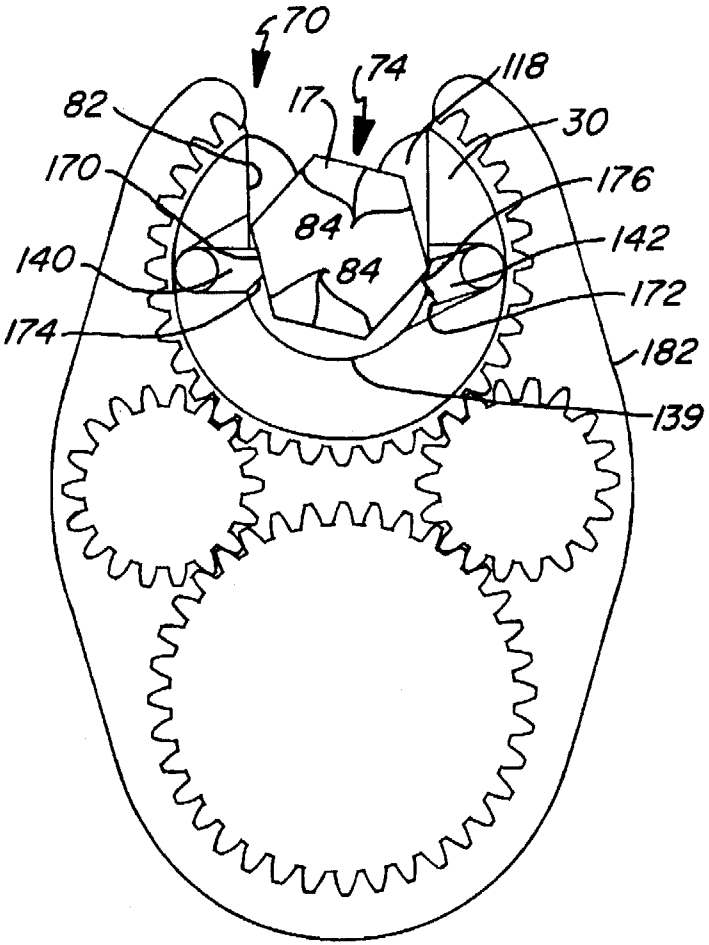
FIGS. 8A through 8C illustrate operation of the split socket of this invention and yet another alternative housing design.
Figure 8C:
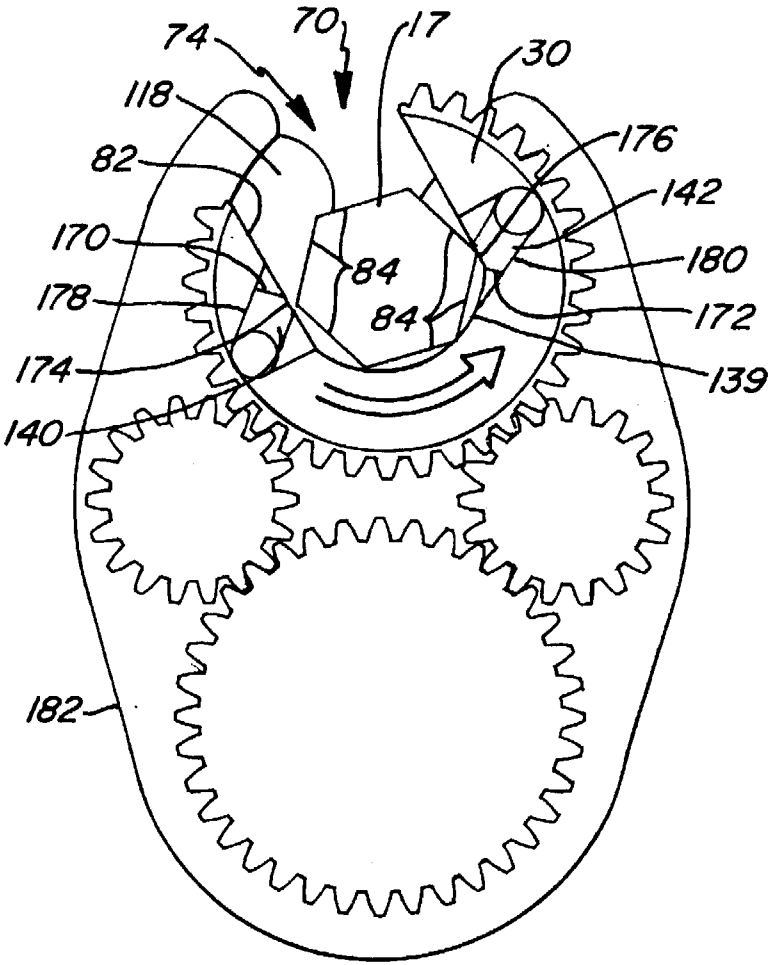
Figure 8B:
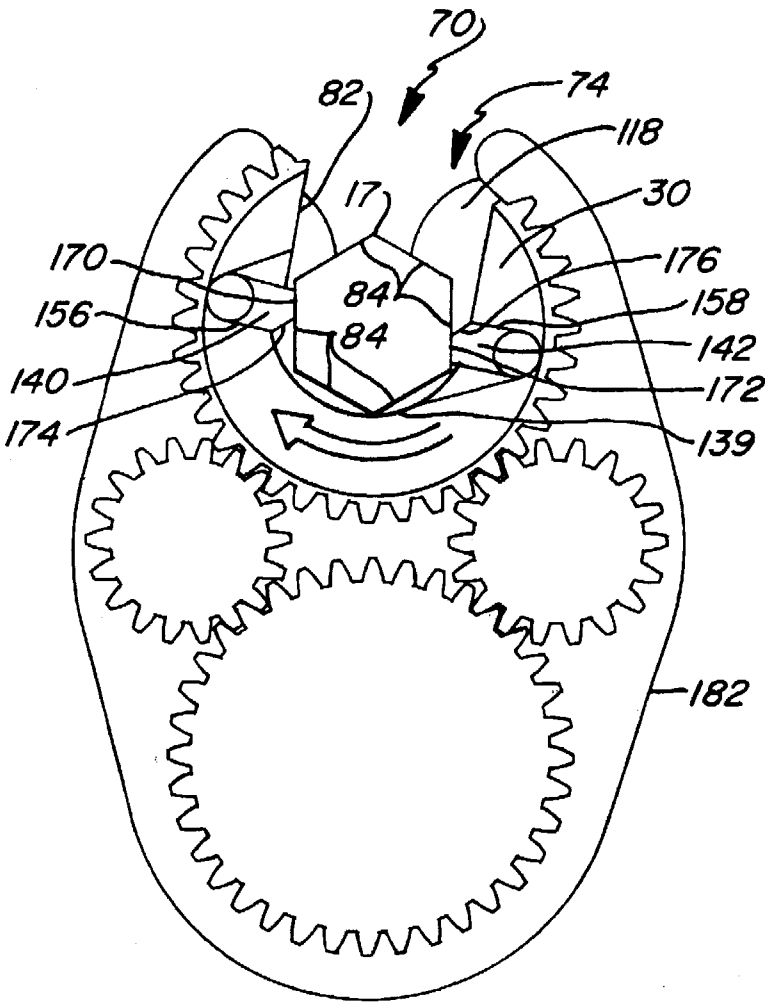

FIGS. 8A through 8C illustrate operation of split socket 30 of this invention in a housing 182 which is similar in most regards to that heretofore described except for overall shape. In FIG. 8A, fitting 17 is being received in socket 30 directly through gaps 70 and 74 in housing 182 and socket 30, respectively. As illustrated, alignment of facets 84 of fitting 17 to allow receipt at inner periphery 82 of socket 30 is unnecessary, since member 142 will pivot to allow receipt of fitting 17 where necessary irrespective of orientation of the facets of fitting 17.

FIG. 8B illustrates the fitting in place contacting arcuate surface 139 and wall 118 thus assuring proper alignment, and with socket 30 having been rotated about 15° (by a driver as illustrated in FIG. 1) bringing facets 170 and 172 of members 140 and 142 into full contact with facets 84 of fitting 17 and with the members at stop walls 156 and 158. Continued rotation in the direction illustrated thus will rotate fitting 17 (the directions of fitting rotation can be reversed simply by reversing the tool on the fitting).

FIG. 8C illustrates the contact by members 140 and 142 at facets 174 and 176 with the fitting to thereby pivot members 140 and 142 toward walls 178 and 180 when socket 30 is rotated in the opposite direction to that shown in FIG. 8B. In this manner, the socket may be rotated (for example to achieve correspondence of gaps 70 and 74 of the housing and socket, respectively) while fitting 17 remains substantially still.

Figure 9:
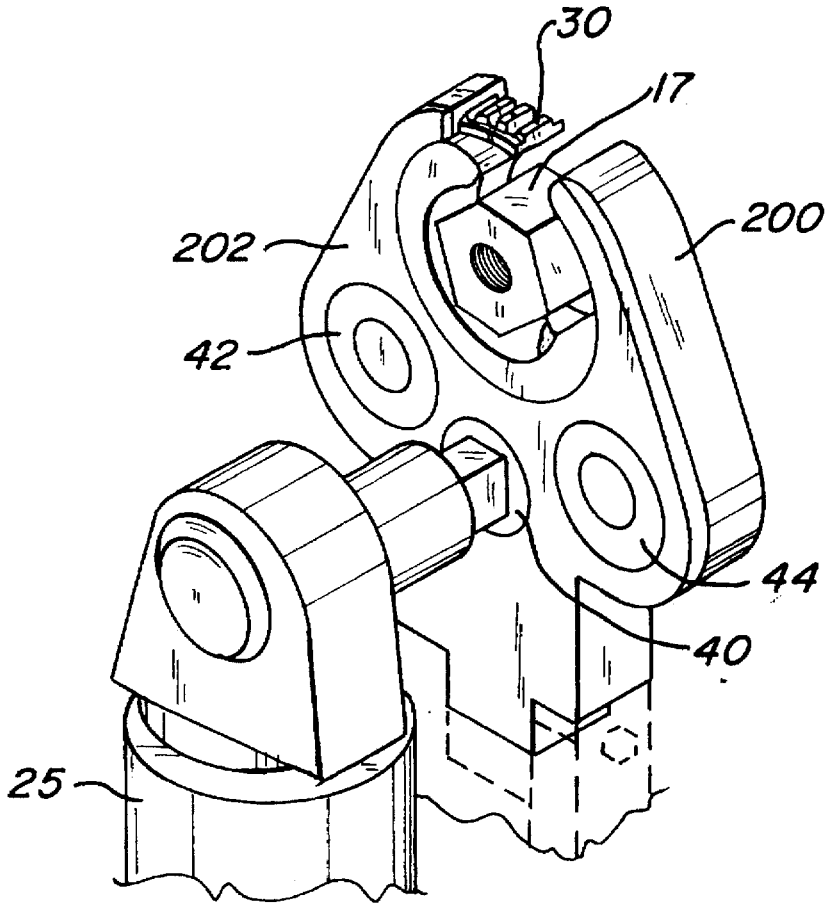
FIG. 9 is a perspective view of another embodiment of this invention.
Figure 10:
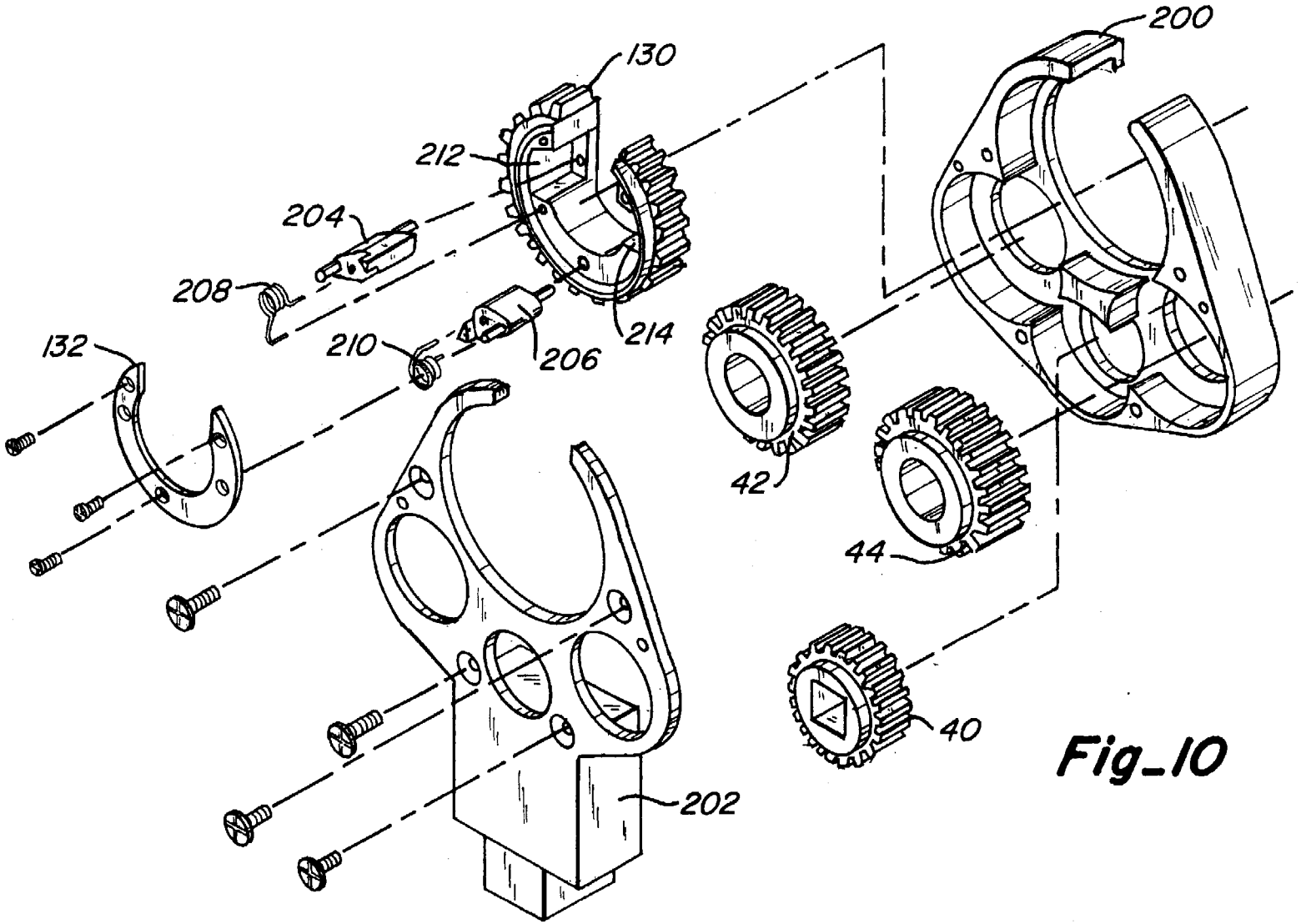
FIG. 10 is an exploded view of the embodiment of the invention shown in FIG. 9.

FIGS. 9 and 10 illustrate another embodiment of this invention similar in most regards to those discussed hereinabove, but with housing body 200 and cover section 202 adapted for larger fittings (and thus the larger gap necessary between linkage gears 42 and 44). In addition, unitary shaft and dog member assemblies 204 and 206 are utilized, with torsion springs 208 and 210 being engaged at the top of the assemblies and indented structures 212 and 214.

Figure 11:
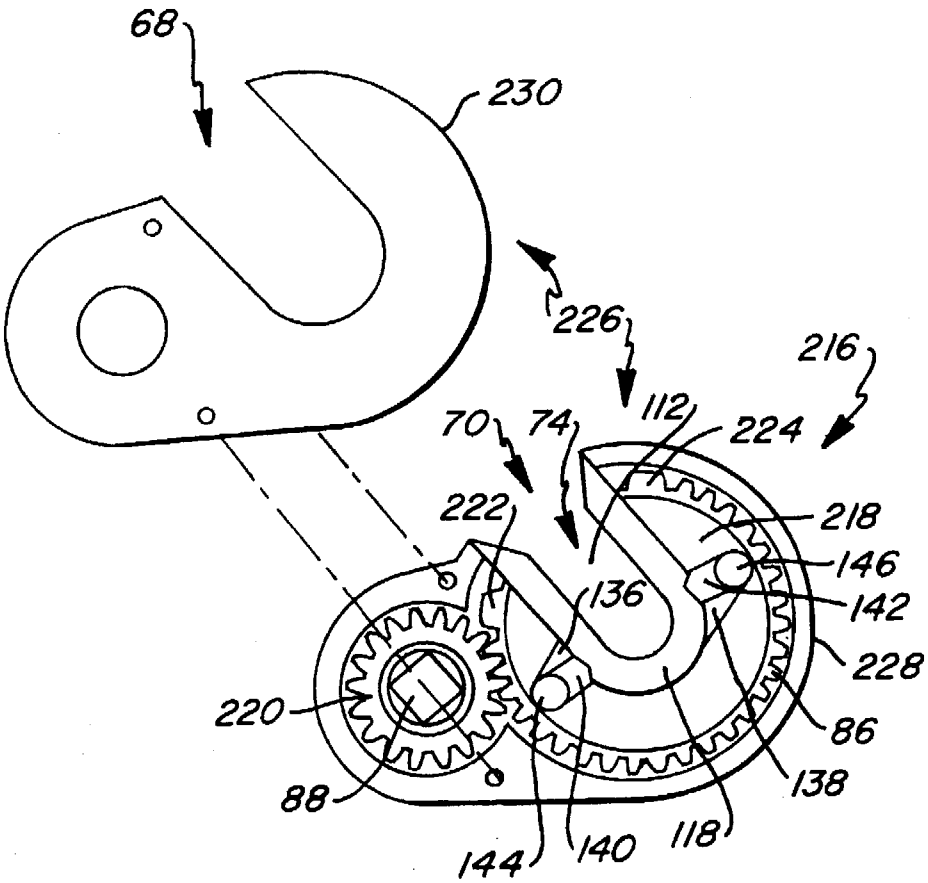
FIG. 11 is a partially exploded illustration of another embodiment of this invention for a direct drive assembly and ratcheting type operation.

FIG. 11 illustrates another embodiment of this invention, with device 216 configured so that socket 218 is directly driven by drive gear 220. Split socket 218 is the same in most regards as that illustrated in FIGS. 6 and 7, but with stop cogs 222 and 224 at outer engageable periphery 86 thereby disallowing engagement of drive gear 220, and thus travel of the socket, therebeyond. Cog 222 is positioned so that gap 74 in socket 218 and gap 70 in housing 226 (defined by housing body 228 and cover section 230) are aligned as shown in the FIGURE when socket 218 is driven in the counterclockwise direction (directions are relative to the orientation of the tool on the fitting), thus providing automatic centering of the gaps. Cog 224 is positioned to allow the maximum rotation of the socket in the clockwise direction without disengagement of socket 218 and drive gear 220. When cog 224 blocks further rotation, the direction of rotation is reversed, the fitting remaining substantially still during counter rotation to cog 222 as heretofore discussed.

This device can be driven manually (with a rotatable ratchet handle engaged at opening 88) or with a power driver to manipulate fittings in a ratcheting fashion. Furthermore, microswitches or the like could be employed to automatically reverse a power driver's direction of rotation when cogs 222 and/or 224 have been engaged at drive gear 220.

Figure 12:
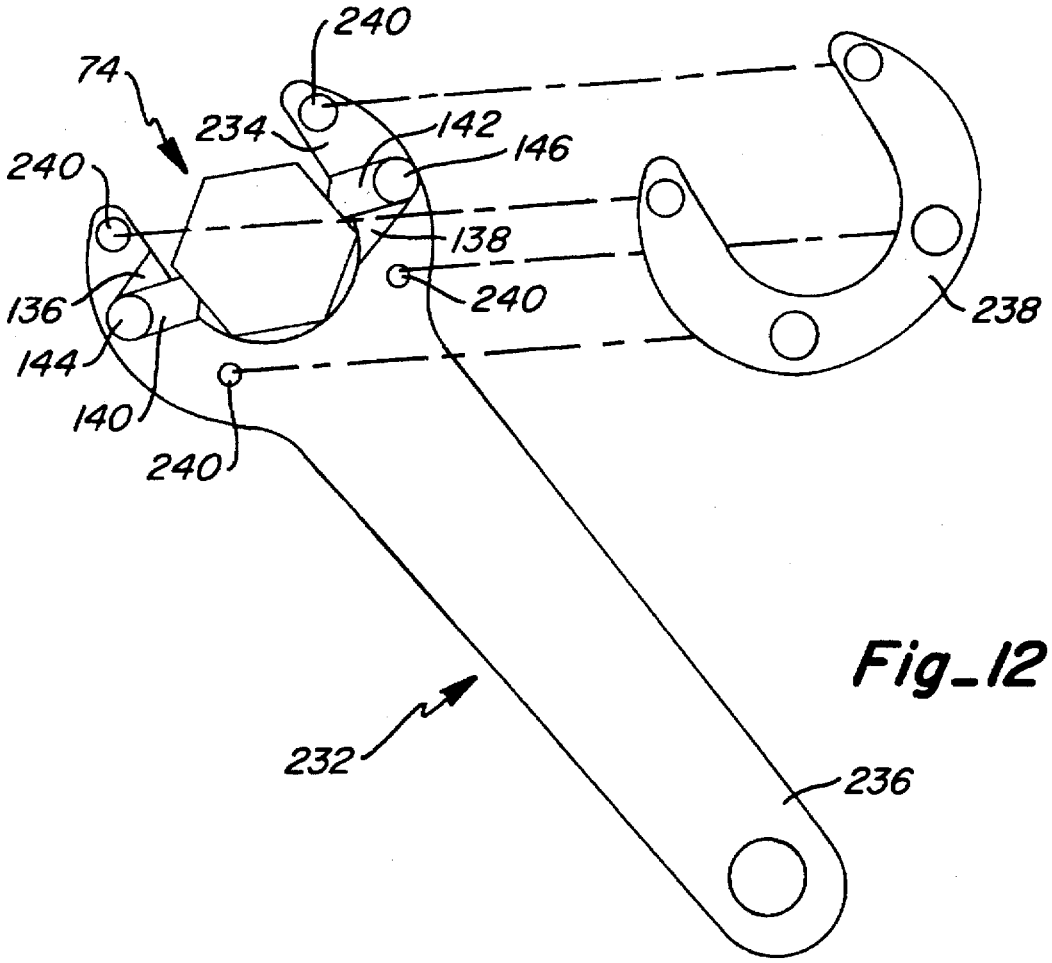
FIG. 12 is an exploded illustration of the socket of this invention configured for use with a handle.

FIG. 12 illustrates the simplest embodiment of the split socket of this invention configured as a ratchet wrench 232. As before, gap 74 is sized, and members 140 and 142, structures 136 and 138 and inner periphery 82 are positioned in wrench head 234 connected with handle 236, as described for socket 30 and as shown in FIGS. 6 and 7. Cover section 238 is attached to wrench head 234 utilizing screws or the like through openings 240.

As may be appreciated, where eccentric running of the socket is no problem, for example in manually driven applications as discussed herein or in slow speed power applications, the socket (or wrench head) of this invention may be utilized with only one dog member 140 or 142 (with gap 74 being appropriately sized) and utilizing surface 78 or 80 opposite the one dog member (or other appropriately configured fixed structure) to hold the fitting once engaged between the dog member and surface for rotation. As heretofore described, the one pivoting member 140 or 142, provided with sufficient range of arc, could in such case be contacted and moved away from the fitting upon opposite rotation so that the fitting remains substantially still.

Used in conjunction with any type of mechanism for bringing the gaps in the housing and in the socket into correspondence, either automatically or manually (as shown, for example, in FIG. 11 for ratcheting type applications; see also U.S. patent application Ser. No. 08/299,211 filed Aug. 31, 1994 and entitled "Mechanism For Locating A Slotted Socket Relative To A Drive Transfer Housing And Combination Thereof" by David Wilson Jr. and Bruce D. Stefen, the contents of which are incorporated hereinto by this reference, which illustrates auto-centering mechanisms for a drive transfer assembly similar to that shown in FIG. 1), this invention allows alignment of the gaps while the socket remains on the line fitting without significant movement of the fitting during the operation. In addition, gap size and socket configuration as taught herein allow "straight on" application of the socket to the fitting (and "straight off" removal) independent of orientation of the facets of the fitting relative to the socket, thus significantly enhancing flexibility and ease of use of the tool, particularly in confined fitting environments.

Figure 14:
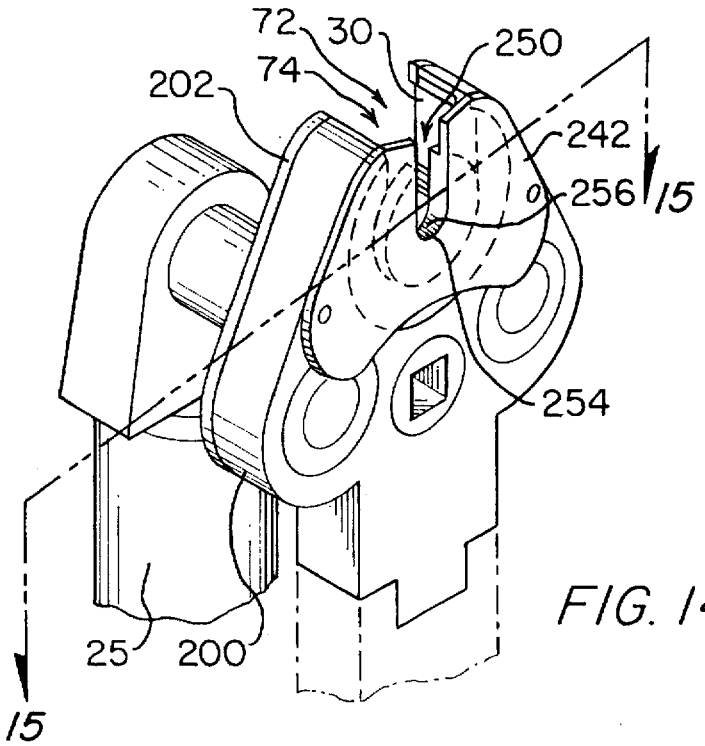
FIG. 14 is a perspective view of a line fitting orientation guide of the sort shown in FIG. 13 attached to a tool as shown in FIG. 9.
Figure 13:
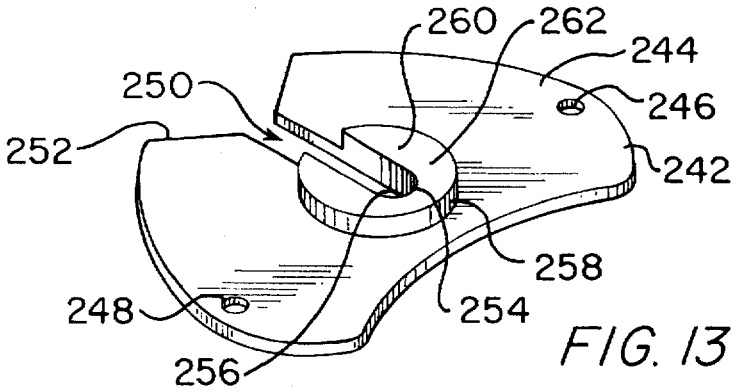
FIG. 13 is a perspective view of a second embodiment of a line fitting orientation guide of this invention that may be attached to a fitting manipulating tool as described herein.
Figure 15:
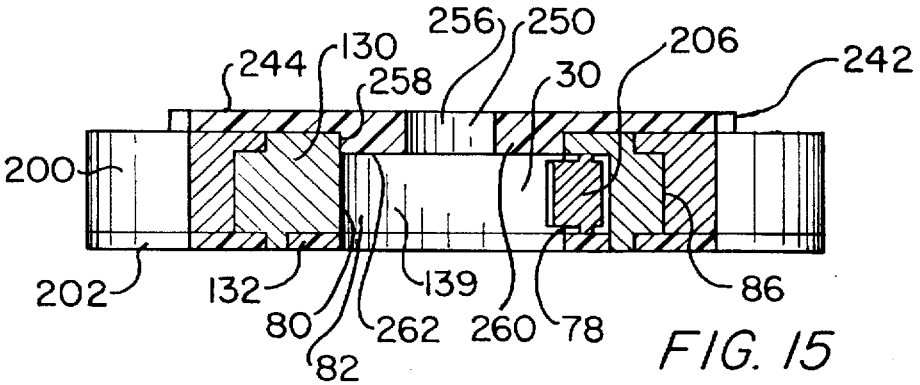
FIG. 15 is a sectional view taken through section line 15—15 of FIG. 14.
Figure 16:
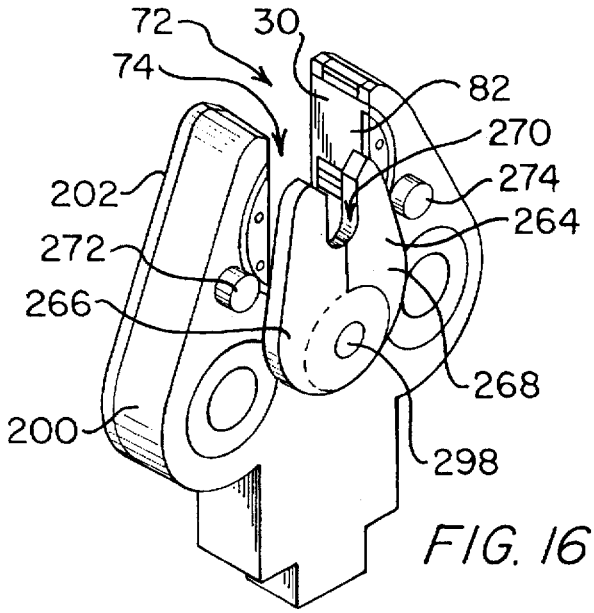
FIG. 16 is a perspective view of a third embodiment of the line fitting orientation guide of this invention attached to a fitting manipulating tool.
Figure 17:
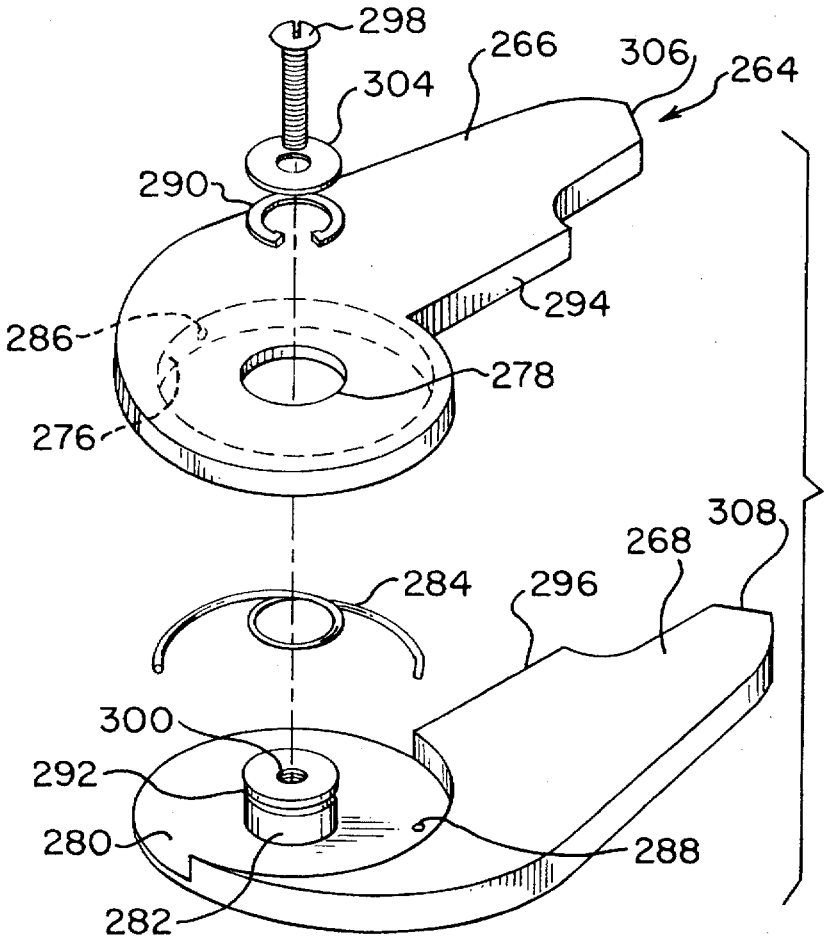
FIG. 17 is an exploded view of the orientation guide of FIG. 16.
Figure 20:
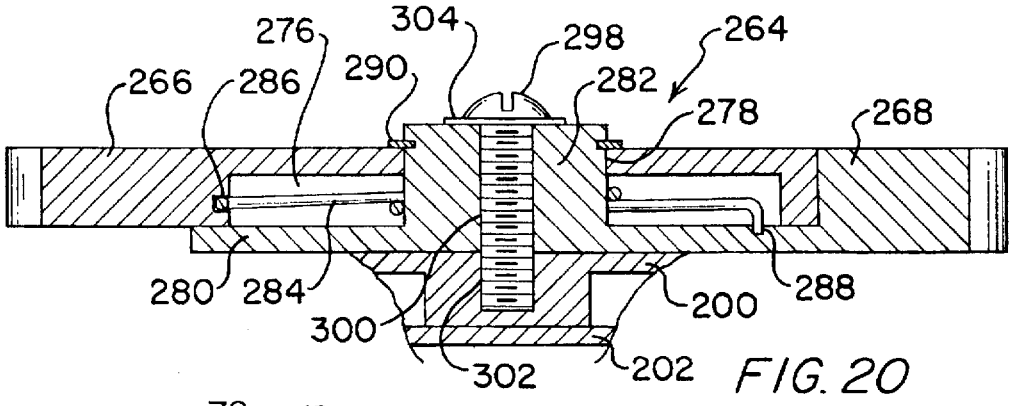
FIG. 20 is a partial sectional view taken through section line 20—20 of FIG. 18.

A second embodiment of the line fitting orientation guide of this invention is shown in FIGS. 13 through 15, this embodiment (unlike the embodiment illustrated in FIGS. 4A, 4B and 5) being an independent structural unit 242 attachable to the housing of the drive transfer assembly (for example, and as illustrated, to housing body 200 or cover section 202 of the drive assembly and socket embodiment illustrated in FIGS. 9 and 10, it being understood that guide unit 242 may be adapted for use with any of the embodiments of drive unit illustrated herein).

Guide unit 242 includes mounting body 244 having mounting openings 246 and 248 therethrough for mounting to housing body 200 (utilizing machine screws or the like). Opening 250 is provided in body 244 and extends from mouth 252 to end 254. Abutment 256 is thus defined at body 244.

Opening 250 is of a size at least equal to the diameter of line 19 and, when mounted, is aligned with gap 72 of housing body 200 and cover section 202 so as to snugly receive the line therethrough as fitting 17 is being passed through gaps 72 and 74 of the drive housing and socket. When fitting 17 is properly positioned in socket 30 for manipulation thereof, line 19 is in contact with abutment 256 (see FIG. 18 which is illustrative of this arrangement but with respect to another embodiment of the guide). Abutment 256 thus provides a bearing surface for line 19, and against which the user may apply pressure during rotation of fitting 17, to prevent accidental dislodgement of the fitting from the socket. When attached to housing body 200, the guide adds strength to the housing, protects line 19 from damage during operation, and locates (i.e., centers) fitting 17 relative to socket 30 precisely, both initially and during operation, for assurance that the fitting will not be rotated eccentrically. This is particularly valuable when using movable members (only one of which, 206, is shown) to grip the fitting as taught hereinabove, or with any other socket utilized which may be prone to being pushed of the fitting by the user during portions of the rotation of the socket.

Arcuate wall 258 extends from body 244 and defines raised portion 260. Opening 250 extends into raised portion 260 with end 254 thereof centrally positioned therethrough. When mounted, arcuate wall 258 is adjacent to arcuate surface 139 of inner periphery 82 of socket 30. Thus abutment 256 is spaced from arcuate surface 139 (a distance about equal to or slightly greater than the radius of a fitting 17 to be manipulated). Wall surface 262 of raised portion 260 provides a positive stop surface for fitting 17 to further assure proper alignment of the fitting.

Figure 18:
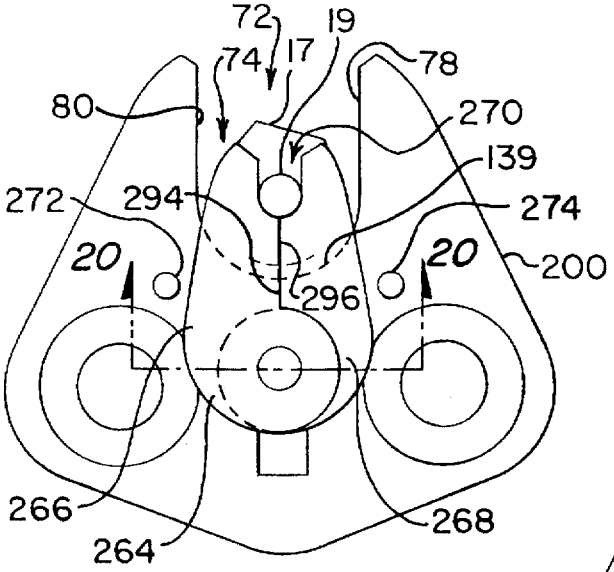
FIG. 18 is a front view of the guide of FIG. 16 in use with a line and a line fitting.
Figure 19:
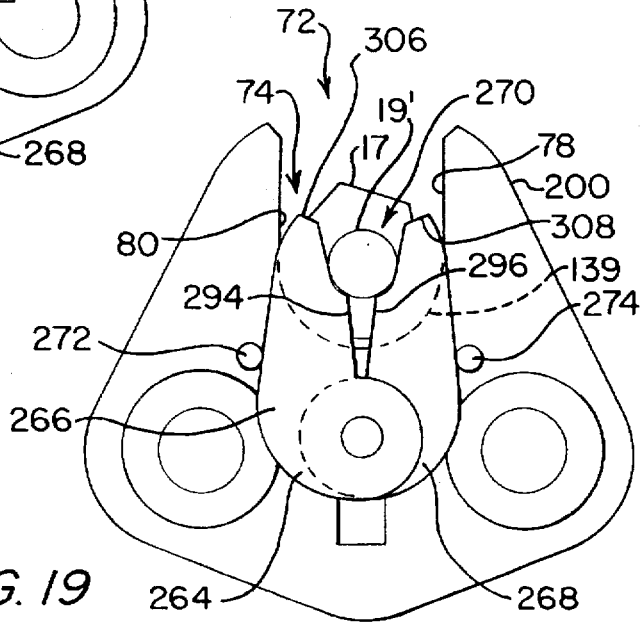
FIG. 19 is a, front view of the guide of FIG. 16 in use on a different sized line.

FIGS. 16 through 20 illustrate a third embodiment 264 of the line fitting orientation guide of this invention offering all of the advantages heretofore set forth while also allowing use with lines of more than one size (19 and 19' in FIGS. 18 and 19). Guide 264 includes first and second relatively moveable members 266 and 268 having fitting receiving opening 270 defined therebetween (the overall character of which is as heretofore described). For use with guide 264, housing body 200 is provided with stop posts 272 and 274.

Member 266 includes arcuate cavity 276 concentrically formed with opening 278. Member 268 includes arcuate ledge 280 concentrically formed with pivot post 282. Spring 284 is mounted over post 282 with one end leg held in aperture 286 in cavity 276 and the other end leg held in aperture 288 in ledge 280. Post 280 is mounted through opening 278 and is held by clip 290 in arcuate slot 292. Spring 284 thus biases surfaces 294 and 296 of members 266 and 268, respectively, toward contact with one another.

Each of the members is free to pivot relative to one another due to mounting on common pivot screw 298 through aperture 300 of post 280, screw 298 being secured in threaded aperture 302 of housing body 200. Washer 304 is provided to assure relative movement when the members are urged apart.

As illustrated in FIGS. 18 and 19, when members 266 and 268 are biased together with surfaces 294 and 296 in contact with one another, line 19 of a first size is snugly receivable in opening 270. However, larger line 19' may be snugly received in opening 270 by relative rotation of members 266 and 268 caused by urging line 19' into opening 270 (i.e., by pressure initially introduced at lips 306 and 308 of members 266 and 268, respectively).

Figure 21:
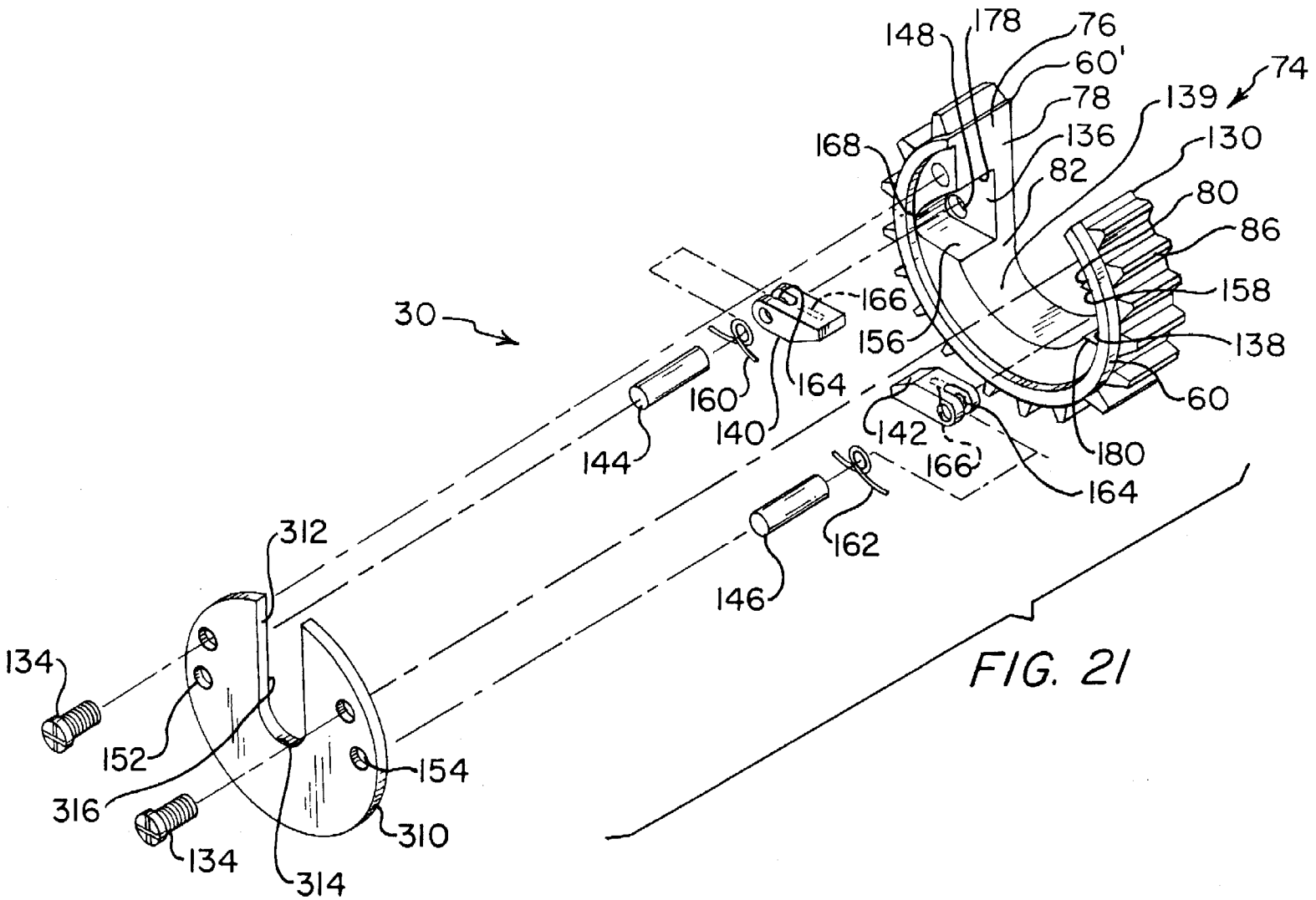
FIG. 21 is an exploded view of the split socket having movable facets of this invention configured with a line fitting orientation guide structure of this invention.

A fourth embodiment of the line fitting orientation guide of this invention is illustrated in FIG. 21, in this case the guide being integral to the structure of socket 30 (of the type shown in FIG. 6). Cover portion 310 of socket 30 has been reconfigured with opening 312 therein of a size selected to accommodate a snug line fit. Abutment surface 314, when in contact with line 19, provides the user bearing surface and alignment of a fitting in socket 30 as heretofore described. Back wall 316 adjacent to opening 312 provides a stop surface (similar to that set forth with respect to wall 118 (FIG. 4A) and surface 162 (FIG. 13)) for further orientation control of the fitting in socket 30.

As may be appreciated, this invention provides a line fitting orientation guide for a fitting manipulating tool including a split socket which better assures proper orientation of the fitting in the split socket during operation, thus preventing eccentric running of the fitting, potential dislodgement of the fitting from the socket, and consequential harm to the line, line fitting or operator. The guides may be configured as required for application to a particular drive or socket, and may be made of any material selected for the task (for example, metal or plastic).

What is claimed is:

1. A line fitting orientation guide for use with a fitting manipulating mechanism, the mechanism including a split socket for rotating a threaded line fitting while the fitting is in place around a line and a drive transfer assembly having the socket rotatably mounted therein and engageable with drive means for rotating the socket, the socket having an inner periphery configured to hold the fitting during manipulation thereof and an outer periphery, a fitting receiving gap in the socket being provided from the outer periphery to the inner periphery, the gap of a size to permit passage of the fitting therethrough, the inner periphery of the socket having first and second spaced surfaces defining the gap in the socket and an arcuate surface extending between the first and second surfaces from one end of each of the first and second surfaces, said guide comprising:

structure at the drive transfer assembly having a line receiving opening aligned with the gap in the socket but of a size different from the gap in the socket and configured to snugly receive the line therethrough when the fitting is being passed through the gap in the socket, said structure including an abutment at one end of said opening for contacting the line when the fitting is properly positioned at the inner periphery of the socket; and said structure including an arcuate wall defining a raised portion extending from a surface of said structure and having at least a part of said opening therethrough with said one end of said opening centrally positioned at said raised portion and spaced from said arcuate wall, said arcuate wall being positionable adjacent to the arcuate surface of the inner periphery of the split socket.

2. The orientation guide of claim 1 wherein the drive transfer assembly of the manipulating mechanism includes a housing having an outer wall, said structure being formed in said wall.

3. The orientation guide of claim 1 wherein the drive transfer assembly of the manipulating mechanism includes a housing having an outer wall, said guide including attachment means for attaching said structure to the wall of the housing.

4. The orientation guide of claim 1 wherein said raised portion provides a positive stop surface for properly aligning the line fitting when received at the inner periphery of the split socket and abutting said stop surface.

5. The orientation guide of claim 1 wherein said structure includes first and second relatively movable members having said opening defined therebetween, said opening size being variable with relative movement between said movable members.

6. A line fitting orientation guide for use with a device for manipulating a threaded line fitting while the fitting is in place around the line, the device for releasable engagement with a power driver and including a split socket having an inner periphery and an engageable outer periphery together defining a part of a side wall, the side wall having a gap large enough to allow passage of the fitting therethrough to the inner periphery of the socket, the inner periphery having an arcuate face at one part thereof, the device further including a drive transfer assembly with a housing having the split socket rotatably mounted therein, the housing having a gap at one part thereof substantially corresponding in one dimension to the gap in the side wall of the socket, the gaps being in register when the socket is rotated to a selected position, said guide comprising:

structure defining a surface and a line receiving opening through said surface of a size different from the gaps in the socket and housing and configured to snugly receive the line therethrough, said structure including an abutment at one end of said opening for contacting the line and means for attachment of said structure to the housing of the drive transfer assembly adjacent to the gap thereat, with said opening in alignment with the gap thereat, and with said surface adjacent to the inner periphery of the split socket, said structure including an arcuate wall defining a raised portion extending from said surface of said structure and having at least a part of said opening therethrough with said one end of said opening centrally positioned at said raised portion and spaced from said arcuate wall, said arcuate wall being positionable adjacent to the arcuate face of the inner periphery of the split socket.

7. The orientation guide of claim 6 wherein said structure includes first and second relatively movable members having said opening defined therebetween and a part of said surface at each one thereof, said opening size being variable with relative movement between said movable members.

8. The orientation guide of claim 7 wherein said relatively movable members are pivotable at a common pivot, said guide further comprising biasing means connected to each of said members for biasing said members toward one another.

9. The orientation guide of claim 6 wherein said abutment at said one end of said opening through said structure is positioned at said surface so that, when said structure is attached to the drive transfer housing, said abutment and the arcuate face of the inner periphery of the split socket are spaced from one another.

* * * * *